US005489098A

United States Patent [19]

Gojny et al.

[11] Patent Number: 5,489,098

[45] Date of Patent: Feb. 6, 1996

[54] GOLF CLUB HEAD AND METHOD OF ITS FABRICATION

[76] Inventors: Francis J. Gojny, 5388 Dressage Dr., Bonita, Calif. 91902; James M. Morin, 27672 Pasatiempo, Mission Viejo, Calif. 92692

[21] Appl. No.: 192,744

[22] Filed: Feb. 7, 1994

[51] Int. Cl.[6] ..... A63B 53/04

[52] U.S. Cl. ..... 273/173; 273/167 J; 228/101

[58] Field of Search ..... 273/167 R, 167 H, 273/167 J, 78, 173; 228/101

[56] References Cited

U.S. PATENT DOCUMENTS

| | | | |
|---|---|---|---|
| 3,218,072 | 11/1965 | Burr | 273/78 |
| 4,199,144 | 4/1980 | Skelly | 273/164 |
| 4,740,345 | 4/1988 | Nagasaki et al. | 264/257 |
| 4,809,978 | 3/1989 | Yamaguchi et al. | 273/78 |
| 5,024,437 | 6/1991 | Anderson | 273/78 |
| 5,062,638 | 11/1991 | Shira | 273/167 R |
| 5,176,384 | 1/1993 | Sata et al. | 273/167 R |
| 5,198,062 | 3/1993 | Chen | 156/245 |

*Primary Examiner*—William H. Grieb
*Attorney, Agent, or Firm*—Edward A. Sokolski

[57] ABSTRACT

A golf club head of cast metal has a cavity formed in the face portion thereof, this cavity being filled with an alloyed material formed from a blended mixture of metallic, refractory, and polymer powders. The golf club head is preheated before the mixture is placed in the club head cavity. After being installed in the cavity the mixture is heated and compressed by the application of force thereto to form a consolidated face plate for the club head which is adhered to the walls of the cavity by virtue of the adhesive properties of the polymer.

18 Claims, 3 Drawing Sheets

GOLF CLUB HEAD AND METHOD OF ITS FABRICATION

BACKGROUND OF THE INVENTION

1. Field of the Invention

This invention relates to golf club heads and more particularly to a golf club head having a face plate formed from a composite of metal, polymer and refractory powders and the method for fabricating such face plate.

2. Description of the Related Art

The characteristics of the face plate of a golf club head are an important factor in determining the control and striking action afforded by the golf club. It is particularly important that the striking surface has a high friction which is capable of enabling the golfer to impart a spin on the ball while evenly distributing the impact energy over the entire face plate so as to allow the entire striking surface to dynamically respond as the "sweet spot." To achieve these desired end results, it is desirable to employ an abrasive, skid resistant surface with an underneath or core material which presents a "soft feel" on stroking yet has the ability to resist deformation caused by high impact loading.

Prior art face plates generally are designed with grooves in the striking surface to effect the desired backspin. Such face plates, as that shown in U.S. Pat. No. 5,198,062 issued Mar. 30, 1993 to Chen, may be fabricated separately and installed in a cavity formed in the face portion of the golf club head. U.S. Pat. No. 3,218,072 issued on Nov. 16, 1965 to Burr shows such an "inserted" face plate which is fabricated of a porous carbon or graphite powder which is impregnated with molten metal or plastic.

BRIEF SUMMARY OF THE INVENTION

The face plate of the present invention provides a significant improvement over prior art face plates by forming the face plate from a composite of refractory powder, metallic powder, and polymer powder. This composite of materials is processed to form a dense homogeneous insert which is integrated into the golf club head. The face of the insert is ground after it is installed to expose a portion of the refractory particulate material, thereby providing a skid resistant surface for imparting backspin to the ball. The refractory particulate material tends to compress into the matrix during the stroke,thereby minimizing damage to the skin of the ball.

The face plate is integrated into the club head by first making a blended mixture of a powder of a refractory material, a powder of metallic material and a powder of polymeric material. The mixture is then installed in a cavity in the face portion of the golf club head. The composite is then consolidated and integrated with the golf club head by applying heat and pressure thereto.

It is therefore an object of the invention to provide a face plate for a golf club head having improved characteristics.

It is a further object of the invention to provide a simpler improved method for integrally incorporating a face plate into a golf club head.

Other objects of the invention will become apparent in connection with the following description in conjunction with the accompanying drawings.

DETAILED DESCRIPTION OF THE INVENTION

Figure 1:
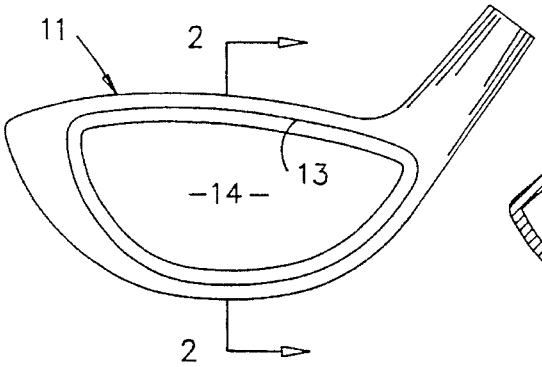
FIG. 1 is a front elevational view of a preferred embodiment of the golf club head of the invention.
Figure 2:
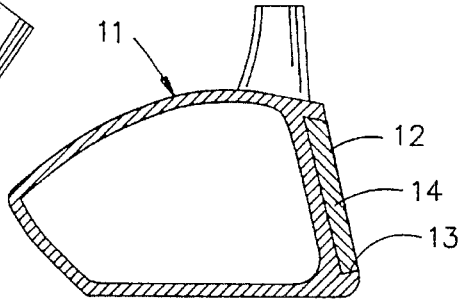
FIG. 2 is a cross sectional view taken along the plane indicated by 2—2 in FIG. 1.

Referring to FIGS. 1 and 2, an embodiment of the golf club head of the invention is illustrated. Golf club head 11 which may be in the form of a metal casting or a machined piece of a metallic, ceramic or polymeric material has a cavity 12 formed in the face portion thereof, this cavity encompassing the entire face of the club except for a narrow strip 13 forming a peripheral lip therearound. Molded into cavity 12 to form an integral part of the club head is an insert 14 which forms the face plate of the head. Insert 14 is formed from a blended powder mixture which includes the following ingredients: 1. A hard refractory carbide, oxide or diboride powder. Powders which may be employed include boron carbide, titanium carbide, silicon carbide, zirconium carbide, silicon oxide, zirconium oxide, titanium oxide, aluminum oxide, titanium diboride, and zirconium diboride. In the preferred embodiment silicon carbide power is employed and comprises 65–85 percent by weight of the mixture with 75 percent by weight being preferred. 2. A thermoplastic or thermoset polymer in powdered form with a mean particle size of 100 mesh and having high compression resistance, abrasion resistance and good binding capabilities. In the preferred embodiment, Nylon 6-6 powder of approximately 300 mesh particle size is employed and comprises 12–28 percent by weight of the mixture with 22 percent by weight being preferred. Other polymers which may be employed include epoxy, nylon, bismaleimide, polyamide-imide, polybutadine, polyethersulfone, polyether-etherketone, and polyphenylone sulfide. 3. A metal powder which preferably has a titanium base and a particle size of 325 mesh which constitutes 1–6 percent by weight of the blended mixture with 3 percent by weight being preferred. In the preferred embodiment, Ti6Al-4V is employed. Other titanium alloys which can be used include $Ti_3Al$, Ti6Al-2Sn-4Zr-2Mo, TiAl, Ti6Al-2Sn-2Zr-6mo, Ti-6Al-6V-2Sn, and Ti-6Al-2Sn-2Zr-2Cr-2Mo-0.25Si.

The blended mixture of powders is molded into cavity 12 to form an integral part of the club head by the following method:

The powders forming the blended mixture are first mechanically blended to assure proper conglomeration and uniform distribution while avoiding premature melting of the polymer. This end result can be achieved by employing a water cooled attrition mill.

The surfaces of the golf club head cavity 12 are sand blasted to increase the surface to volume ratio of such surfaces to promote improved bonding of the polymer in the powdered mixture to such surfaces. The golf club head is then preheated in a heating device which will maintain a stable temperature tolerance such as a commercially available box furnace to a temperature which is approximately 20 percent lower than the consolidation temperature of the powder mixture. In the preferred embodiment, this temperature is 480° F.

Figure 3:
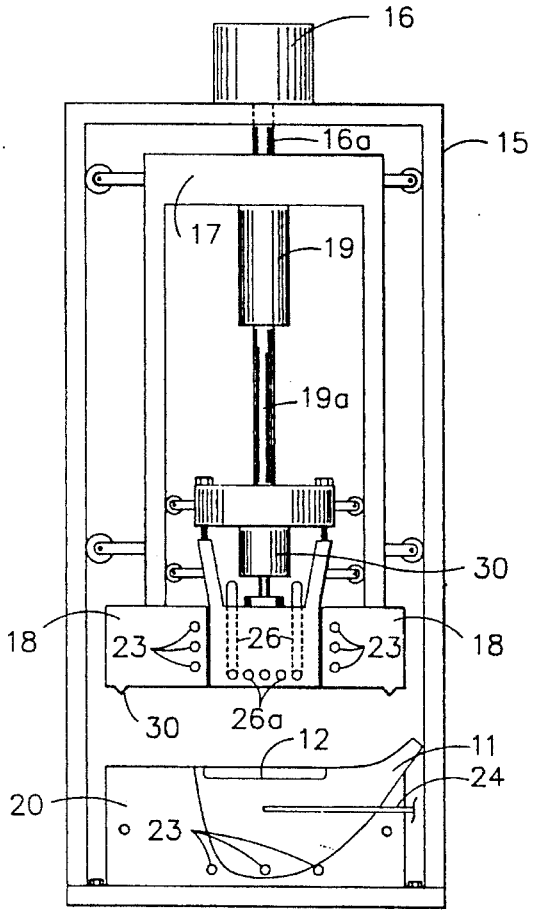
FIG. 3 is a schematic drawing illustrating a step in the method of the invention.

Referring now to FIG. 3, apparatus for molding the powdered mixture and consolidating this mixture with the club head is illustrated. This apparatus includes a support frame 15 having die mold ram 16 supported on the top portion thereof. The ram rod 16*a* of ram 16 is attached to inner support frame 17 and when actuated to its "up-stroke" position, as shown in FIG. 3, draws support frame 17 upwardly and along with it the upper half 18 of the die mold which is attached to frame 17. Also lifted upwardly is die cavity ram 19 the shaft 19*a* of which is connected to the upper half 18 of the die mold. With the ram 16 in the up-stroke position of FIG. 3, the preheated club head is placed in position in the lower half 20 of the die mold. The ram 16 is then actuated to its "down stroke" position, as shown in FIG. 4.

The die mold has heating elements 23 distributed thereabout which are controlled by a thermocouple 24 which maintains the temperature of the mold at 560–600 degrees F.

Figure 4:
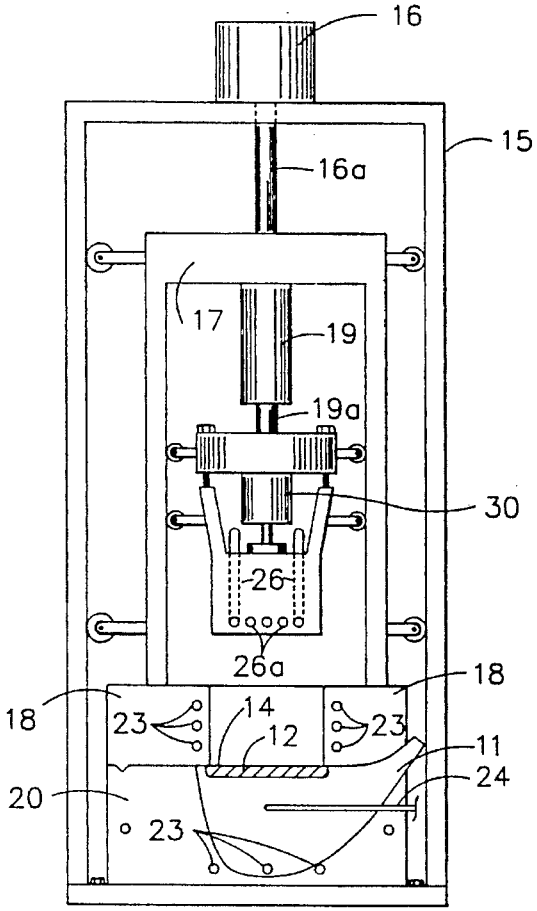
FIG. 4 is a schematic drawing illustrating a step in the method of the invention subsequent to that shown in FIG. 3.
Figure 5:
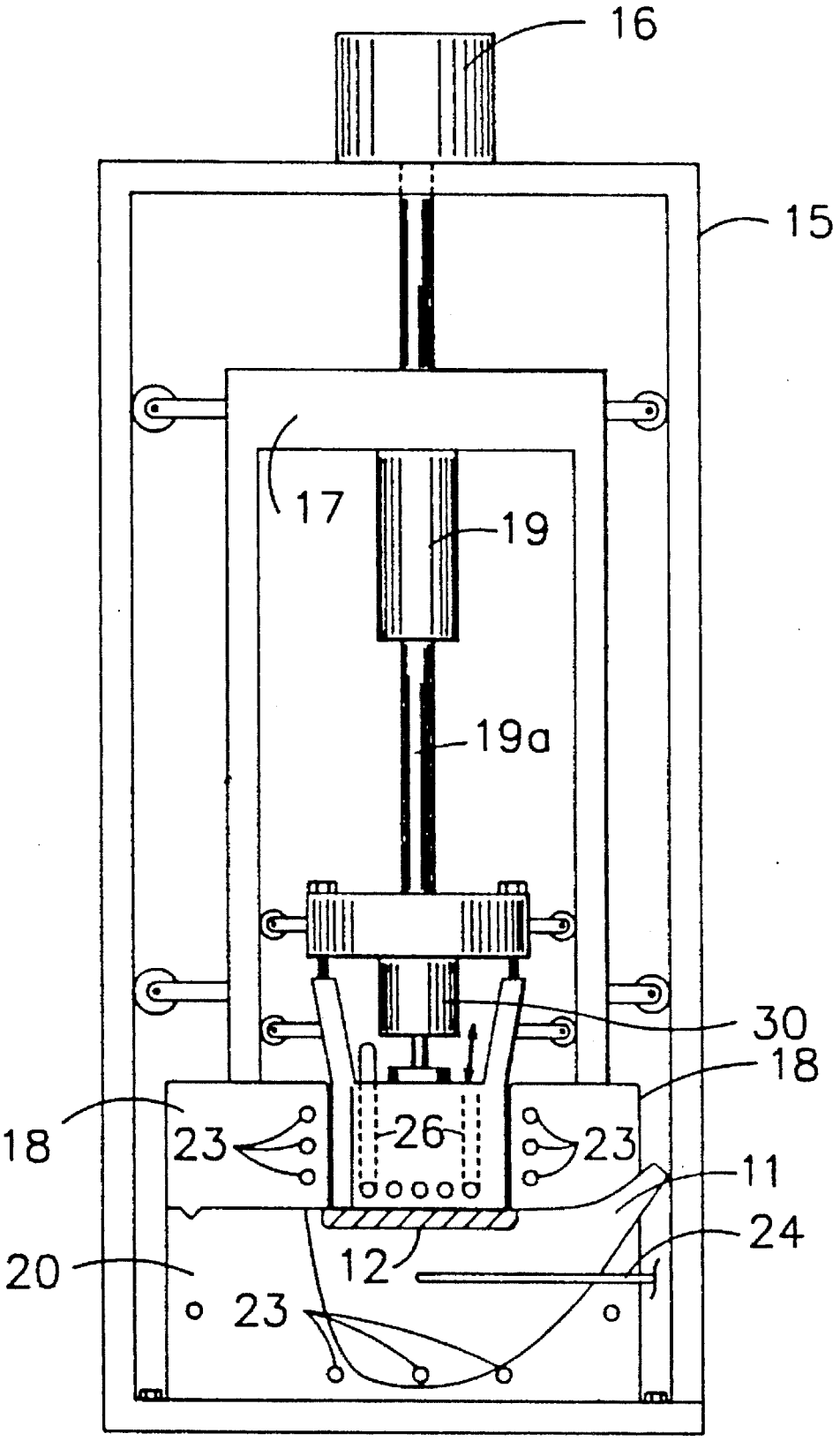
FIG. 5 is a schematic drawing illustrating a step in the method of the invention subsequent to that shown in FIG. 4.

With the club head seated in the mold, the die cavity ram 19 is now actuated to its "up-stroke" position, as shown in FIG. 4. This draws plunger 26 upwardly as shown in the figure, exposing the club head cavity 12. The blended powder mixture is now placed in cavity 12 and leveled to a consistent plane. Ram 19 is then actuated to its "down-stroke". position as shown in FIG. 5 with pressure of approximately 100 psi being placed on the mixture, this mixture being heated to 560–600 degs F. by virtue of the heating elements 23. The pressure is maintained until the powder melts and secondary consolidation and compression is observed.

Reciprocating cylinder 30 is then activated to dynamically tamp and forge the consolidated mixture for maximum consolidation while imparting residual internal stress within the consolidated material. The outer surface of the consolidated insert is then rapidly chilled to retain the induced compressire stresses. This is achieved by flowing a chilled brine solution at about 8 degrees F. through cooling channels 26*a* formed in plunger 26. Finally, ram 16 is actuated to its up-stroke position and the club head removed from the mold and further chilled by placement in a commercially available chill box to bring the entire head to room temperature as rapidly as possible.

plunger 26 can be provided with striations or other markings thereon to form grooves or other markings on the surface of the insert. The surface of the insert material which forms the face plate of the club head is preferably ground to expose a portion of the refractory material thereby providing a high friction striking surface for the face of the club head. It is further to be noted that locating pins 30 are provided in the upper mold half which matingly engage apertures formed in the lower mold half to properly locate the molds relative to each other.

Figure 6:
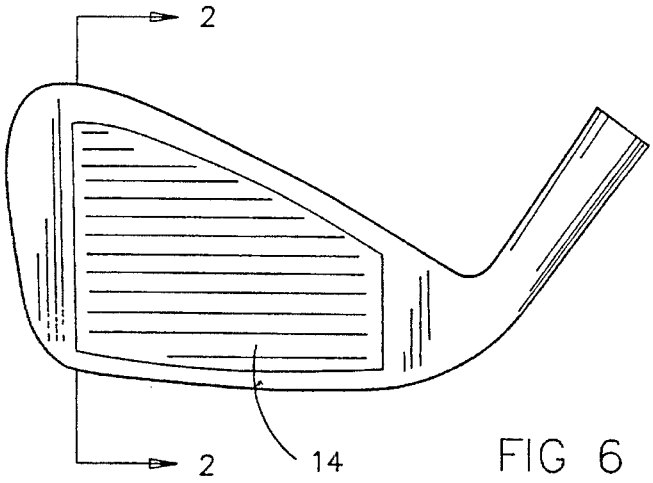
FIG. 6 is a front elevational view of a second embodiment of the invention.
Figure 7:
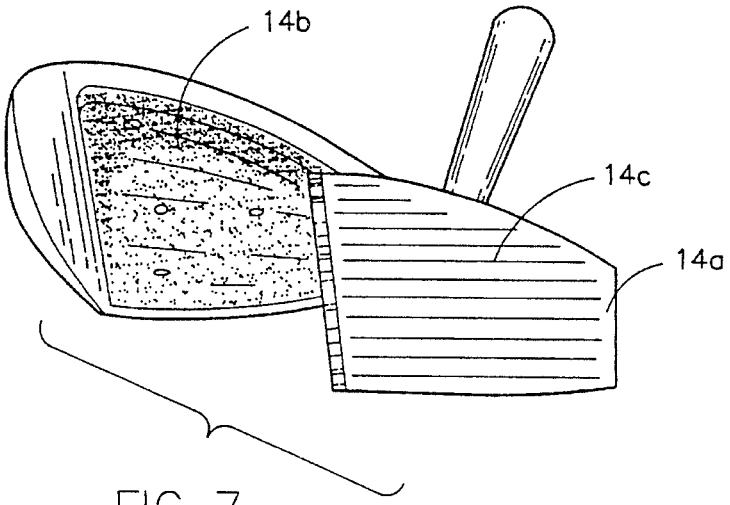
FIG. 7 is an exploded view illustrating the fabrication of the second embodiment.
Figure 8:
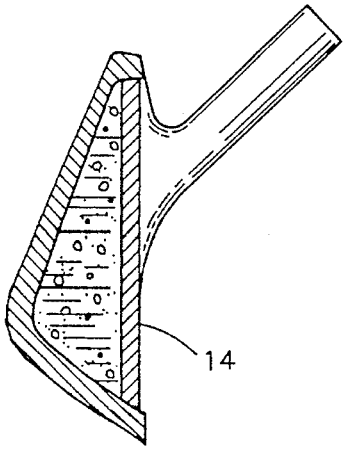
FIG. 8 is a cross sectional view taken along the plane indicated by 8—8 in FIG. 6.

Referring now to FIGS. 6–8, a second embodiment of the invention is illustrated. This embodiment is fabricated by the same method as described for the first embodiment but involves the placement of a metallic plate 14*a* over the powder mixture 14*b* to form a consolidated face plate 14. Plate 14*a* may be made from an iron, nickel or tatanium based alloy such as iron based 17-4 PH, 430 stainless steel, 4130 or 416 stainless steel alloy; nickel based-inconel 625, inconel 718, Rene 41 or Waspalloy alloy; Titanium based-Ti 6al-4v, Ti 3al, Ti 6al-2sn-2zr-2cr-2mo-0.25si, or Ti 6al-2sn-4zr-2mo, the preferred alloy being Ti 6al-2sn-4zr-2mo.

The metallic plate is preheated along with the club head in the manner of the first embodiment. The preheated plate is placed over the powdered mixture after such mixture is placed in cavity 12 and prior to the actuation of ram 19. The plate 14*a* is joined to the powdered mixture to form a consolidated mass with the application of heat and pressure as described in connection with the first embodiment.

Plate 14*a* may have a surface preformed with grooves 14*c* or other markings to provide a skid resistant striking face.

While the invention has been described and illustrated in detail, it is to be clearly understood that this is intended by way of example only and is not to be taken by way of limitation, the scope of the invention being limited only by the terms of the following claims.

We claim:

1. In a golf club head having a cavity formed in the face portion thereof, a face plate formed in said cavity by the method comprising:

mixing a powder of refractory material with a powder of polymeric material and a powder of metallic material to form a blended mixture, pre-heating said club head to a predetermined temperature, placing said blended mixture in the club head cavity, and simultaneously compressing and heating said mixture to form a consolidated mass which is adhered to the surfaces of the club head.

2. The golf club head of claim 1 wherein said club head is pre-heated to a temperature of substantially 480 degrees F and said blended mixture is heated to a temperature of 580–600 degrees F.

3. The golf club head of claim 1 wherein said consolidated mass is tamped after it has been compressed.

4. The golf club head of claim 1 wherein the surface of said face plate is ground to expose a portion of the refractory material.

5. The golf club head of claim 1 wherein said blended mixture comprises 65–85 percent by weight of refractory material, 12–28 percent by weight of polymeric material and 1–6 percent by weight of metallic material.

6. The golf club head of claim 1 wherein said blended mixture comprises substantially 75 percent by weight of refractory material, 22 percent by weight of polymeric material and 3 percent by weight of metallic material.

7. The golf club head of claim 1 wherein said refractory material comprises silicon carbide, said polymer comprises Nylon 6-6 powder and wherein said metallic powder has a titanium base.

8. The golf club head of claim 1 wherein said refractory material is selected from the class consisting of carbides, oxides and diborides.

9. The golf club head of claim 8 wherein said refractory material is silicon carbide, said polymeric material is Nylon 6-6 powder, and said metallic material includes titanium.

10. In a golf club head having a cavity formed in the face portion thereof, a face plate formed in said cavity by the method comprising:

mixing a powder of refractory material with a powder of polymeric material and a powder of metallic material to form a blended mixture, pre-heating said club head to a predetermined temperature, placing said blended mixture in the club head cavity, placing a metallic face plate over said blended mixture, and simultaneously compressing and heating said mixture and said face plate to form a consolidated mass which is adhered to the surfaces of the club head.

11. The golf club head of claim 9 wherein the consolidated mass is tamped after it has been compressed.

12. The golf club head of claim 10 wherein said blended mixture comprises 65–85 percent by weight of refractory material, 12–28 percent by weight of polymeric material, and 1–6 percent by weight of metallic material.

13. The golf club head of claim 10 wherein said blended mixture comprises substantially 75 percent by weight of refractory material, 22 percent by weight of polymeric material and 3 percent by weight of metallic material.

14. The golf club head of claim 10 wherein said club head is heated to approximately 480 degrees F prior to the placement of the blended powders therein and said powder mixture is heated to 560–600 degrees F.

15. The golf club head of claim 9 wherein said refractory material is selected from the class consisting of carbides, oxides, and diborides.

16. A method for forming a face plate in a golf club head comprising the steps of:

forming a golf club head with a cavity in the face portion thereof, mixing powders of refractory material, polymeric material and metallic material to form a blended mixture, heating the club head to a predetermined temperature, placing said blended powder mixture into said club head cavity, and compressing and heating said mixture to form a consolidated mass which is adhered to the surfaces of said club head.

17. The method of claim 16 wherein after tamping, the surface of said consolidated mass is ground to expose a portion of the refractory material.

18. A method for forming a face plate in a golf club head comprising the steps of:

forming a golf club head with a cavity in the face portion thereof, mixing powders of refractory, polymeric and metallic materials to form a blended mixture, heating the club head to a predetermined temperature, placing said blended powder mixture into said club head cavity, placing a metallic face plate against said blended mixture, and compressing and heating said face plate and said blended mixture to form a consolidated mass which is adhered to the surfaces of said club head.

* * * * *